US007906741B2

(12) United States Patent
Yanai et al.

(10) Patent No.: US 7,906,741 B2
(45) Date of Patent: Mar. 15, 2011

(54) PUSH SWITCH AND ELECTRONIC DEVICE LOADED THEREWITH

(75) Inventors: Yasunori Yanai, Okayama (JP); Yoshikazu Yagi, Okayama (JP); Masahiro Masuda, Okayama (JP); Takashi Tomago, Okayama (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/578,697

(22) Filed: Oct. 14, 2009

(65) Prior Publication Data

US 2010/0089733 A1 Apr. 15, 2010

(30) Foreign Application Priority Data

Oct. 14, 2008 (JP) ..... 2008-265051

(51) Int. Cl.
*H01H 5/18* (2006.01)

(52) U.S. Cl. ..... 200/406

(58) Field of Classification Search ..... 200/406, 200/16 R–16 D, 292–296, 303, 547, 548, 200/536
See application file for complete search history.

(56) References Cited

U.S. PATENT DOCUMENTS

| | | | | |
|---|---|---|---|---|
| 7,442,057 | B2 * | 10/2008 | Ko | 439/101 |
| 7,564,004 | B2 * | 7/2009 | Nishimura et al. | 200/536 |
| 2006/0082558 | A1 * | 4/2006 | Chen et al. | 345/184 |

FOREIGN PATENT DOCUMENTS

| | | |
|---|---|---|
| JP | 2001-210176 | 8/2001 |
| JP | 2007-329022 | 12/2007 |

* cited by examiner

*Primary Examiner* — Edwin A. Leon
(74) *Attorney, Agent, or Firm* — Wenderoth, Lind & Ponack, L.L.P.

(57) ABSTRACT

A configuration of a push switch minimizes the extent to which the switch protrudes from a wiring board, and thereby allows for a device including the switch to have smaller dimensions. Minimizing the height by which the switch protrudes above the wiring board also minimizes the moment caused by the pressing the switch which is transferred to terminals soldered to the wiring board, and thus improves the mechanical strength of the attachment to the wiring board. The configuration includes, in part, a case having a terminal protruding therefrom, wherein a lower surface position of the terminal where soldering is performed is located above a bottom surface of the case.

16 Claims, 12 Drawing Sheets

PUSH SWITCH AND ELECTRONIC DEVICE LOADED THEREWITH

FIELD OF THE INVENTION

The present invention relates to a push switch, which is used for input operating sections or the like of a variety of electronic devices and is functioned by pushing in the operating section from a direction parallel to the surface of a mounted wiring board, and also relates to an electronic device loaded with the push switch.

BACKGROUND OF THE INVENTION

In recent years, a variety of electronic devices are increasingly downsized, slimmed down and multifunctional, and a push switch for use in input operating sections of those electronic devices also has an increased mounting density. A push switch of a so-called horizontal push type, which is mounted at an edge section of a wiring board of an electronic device and operated by pushing in an operating section from a direction parallel to the surface of the wiring board, has also been increasingly adopted.

Such a conventional push switch is described with reference to FIGS. 12 and 13. FIG. 12 is an exploded perspective view of a conventional push switch. FIG. 13 is a side sectional view of a mounted state of the conventional push switch.

In FIGS. 12 and 13, numeral 1 denotes a case made of an insulating resin in a substantially rectangular shape seen from above, having open-top concave section 1A, and on the inner bottom surface of that concave section 1A, central fixed contact 2 and outer fixed contact 3 are electrically independently provided by insert molding. Terminals 2A, 3A respectively extended from central fixed contact 2 and outer fixed contact 3 are also fixed by insert molding, and each led outward from case 1. Further, in a position of a front bottom section of case 1, downward projection 1B projecting downward is provided.

Numeral 4 denotes an open-bottom circular dome-shaped movable contact made of an elastic metal sheet, which is housed inside concave section 1A of case 1, the peripheral lower end of which is placed on outer fixed contact 3, and the lower surface of the dome-shaped central section of which is opposed to central fixed contact 2 with a space formed therebetween. Numeral 5 denotes a protective sheet made of an insulating film and provided with an adhesive, not shown, on its lower surface, and the protective sheet is made to adhere to the upper surface position of the periphery of concave section 1A of case 1 so as to cover concave section 1A.

Numeral 6 denotes an operating body made of an insulating resin, provided with operating section 6A located in a projecting manner on the front surface side of case 1, the operating body having behind operating section 6A bar-shaped elastic projection 6B with its end formed as pushing section 6C in substantially spherical shape, and being provided with sliding section 6D in frame shape so as to surround the periphery of that elastic projection 6B. This sliding section 6D is longitudinally movably placed on protective sheet 5.

Numeral 7 denotes a cover which is made of a metal plate and controls upward movement of operating body 6, and the cover is fixed to case 1 while pushing section 6C at the end of elastic projection 6B of operating body 6 is in a contact state with the front surface of inclined surface 7A provided in the central portion.

Next described is an operation of the conventional push switch configured as above. First, when operating section 6A of operating body 6 is pushed in backward, sliding section 6D moves backward on protective sheet 5. Pushing section 6C at the end of elastic projection 6B, which is in contact with inclined surface 7A of cover 7, moves as guided diagonally downward along inclined surface 7A. The diagonally downward movement of pushing section 6C applies push-down force to movable contact 4 through protective sheet 5. When the push-down force exceeds elastic reverse force of movable contact 4, the dome-shaped portion of movable contact 4 is transformed into a bottom convex shape accompanied by a sense of click, and its lower surface comes into contact with central fixed contact 2 to which the lower surface is opposed downward, so that the switch is turned on.

When the force having pushed in operating section 6A is released, by self-restoring force of movable contact 4, movable contact 4 is restored to the original dome shape rounded upward, accompanied by a sense of click, and the above-mentioned lower surface of the central section is separated from central fixed contact 2, so that the switch is turned off. At that time, elastic projection 6B is pushed back upward by the self-restoring force of movable contact 4, and pushing section 6C at the end of elastic projection 6B moves as guided diagonally upward along inclined surface 7A of cover 7. With the movement of pushing section 6C, sliding section 6D moves forward on protective sheet 5, and operating body 6 returns to the original state.

As shown in FIG. 13, in the push switch, terminals 2A, 3A are soldered and mounted with downward projection 1B of case 1 in the state of being inserted in rectangular cut-out section 12 provided at the edge section of wiring board 11.

In this mounting state, when operating section 6A of operating body 6 is pushed in parallel to the surface of wiring board 11 for operation, downward projection 1B provided in case 1 prevents separation of the soldered portions of terminals 2A, 3A against an excessive load applied to operating body 6, by its rear surface coming to wiring board 11.

It is to be noted that as related art relevant to the invention of this application, for example, Unexamined Japanese Patent Publication Nos. 2007-329022 (Patent Document 1), 2001-210176 (Patent Document 2), and the like are known.

In response to slimming down of a variety of electronic devices, the conventional push switch has also been required to be further slimmed down while holding its mechanical strength, notably separation strength of the soldered portion.

However, the conventional push switch has a structural limit on the lowering of its height from the surface of wiring board 11. Further, although the form of Patent Document 2 is also known, this has a projection toward the lower surface of a wiring board, thus having the problem of being unable to satisfy the need for slimming down.

SUMMARY OF THE INVENTION

A push switch of the present invention includes a case, an open-bottom dome-shaped movable contact made of an elastic metal sheet, a protective sheet, an operating body, and a cover. The case has on a plane surface an open-top concave section housing the movable contact, and includes a plurality of electrically independent fixed contacts on an inner bottom surface of the concave section, and surface-mounted type terminals connected to the plurality of fixed contacts and led outward. The operating body includes an operating section projecting ahead of the case, and is longitudinally movably placed on the protective sheet. The cover is fixed to the case from above the operating body. The terminal is led outward from a side section of the case, and a lower surface position of the terminal where soldering is performed is located above a bottom surface of the case.

Thereby, the case portion located below the soldered position of the terminal is inserted and mounted into the cut-out section provided at the edge section of the wiring board of the device. It is possible to provide a push switch that can be mounted while a height position where an operation to the operating body is performed is in a state close to the wiring board surface side, to suppress a moment of the pressing operation applied to the soldered section after the mounting so as to have an advantage in mechanical strength and suppress the height from the wiring board surface in the mounted state.

In another push switch of the present invention, the inner bottom surface of the concave section of the case is located below the lower surface position of the terminal where soldering is performed. Since the internal structure of the push switch can be configured to be lowered in position, the height from the wiring board can further be suppressed.

In another push switch of the present invention, a rest section is provided which projects outward more in an upper portion of each of at least right and left side sections of the case than in a lower portion thereof, with the lower surface position of the led-out terminal taken as a border. Providing the rest section to be placed on the wiring board in contact therewith allows stable placement of the push switch in the cut-out section, so as to improve mounting operationality.

In another push switch of the present invention, a corner projecting section is provided in a projecting manner in L shape at each corner section of the plane surface of the case, a step section projecting from the plane surface at a position higher than an upper surface of the protective sheet is formed in a base of the corner projecting section, and the sliding section of the operating body is placed on the upper surface of the step section. This allows the operating body to move smoothly free of friction with the protective sheet at the time of longitudinally moving on the step section, so as to give a favorable operational feel.

In another push switch of the present invention, two each of the terminals are provided in symmetrical positions of the case, and a width of the terminal located on the front side is set larger than a width of a rear terminal located on a rear side. It is possible to increase mechanical strength after solder-mounting against a moment of the pressing operation that is intensely applied to the front-side terminal.

In another push switch of the present invention, the terminal is provided with a cut-out section. Since this cut-out section acts as a solder pool at the time of soldering, it is possible to increase the mechanical strength after solder-mounting.

In another push switch of the present invention, two each of the terminals are provided in symmetrical positions of the case, and the terminal located on the front side is bent downward on its end side. The bent end side is inserted into a through hole provided in the wiring board to be solder-mounted, whereby it is possible to increase mechanical strength after solder-mounting against a moment of the pressing operation that is intensely applied to the front-side terminal.

An electronic device of the present invention has a wiring board provided with a cut-out section into which the push switch is inserted, and a space from a back-side end surface of the cut-out section to a center of a longitudinal width of the land for a terminal is set shorter than a space from a rear-end section of the push switch in contact with the back-side end surface of the cut-out section to a center of a width of the terminal. When molten solder is solidified, condensing force acts to achieve balance such that each terminal is located at the center of the land width, whereby the push switch is energized toward the back side of the cut-out section and solder-fixed to the back-side end surface in a close contact state therewith. This can result in stabilization of the position on the wiring board as well as improvement in mechanical strength due to direct reception of an excessive load on the end surface of the wiring board at the time of application of the load to the operating section.

As thus described, according to the present invention, it is possible to provide a push switch with its height from a wiring board suppressed in a mounted state without causing deterioration in mechanical strength, and also provide an electronic device loaded with the push switch.

DETAILED DESCRIPTION OF THE INVENTION

Embodiments of the present invention are described below with reference to FIGS. 1 to 11.

Figure 1:
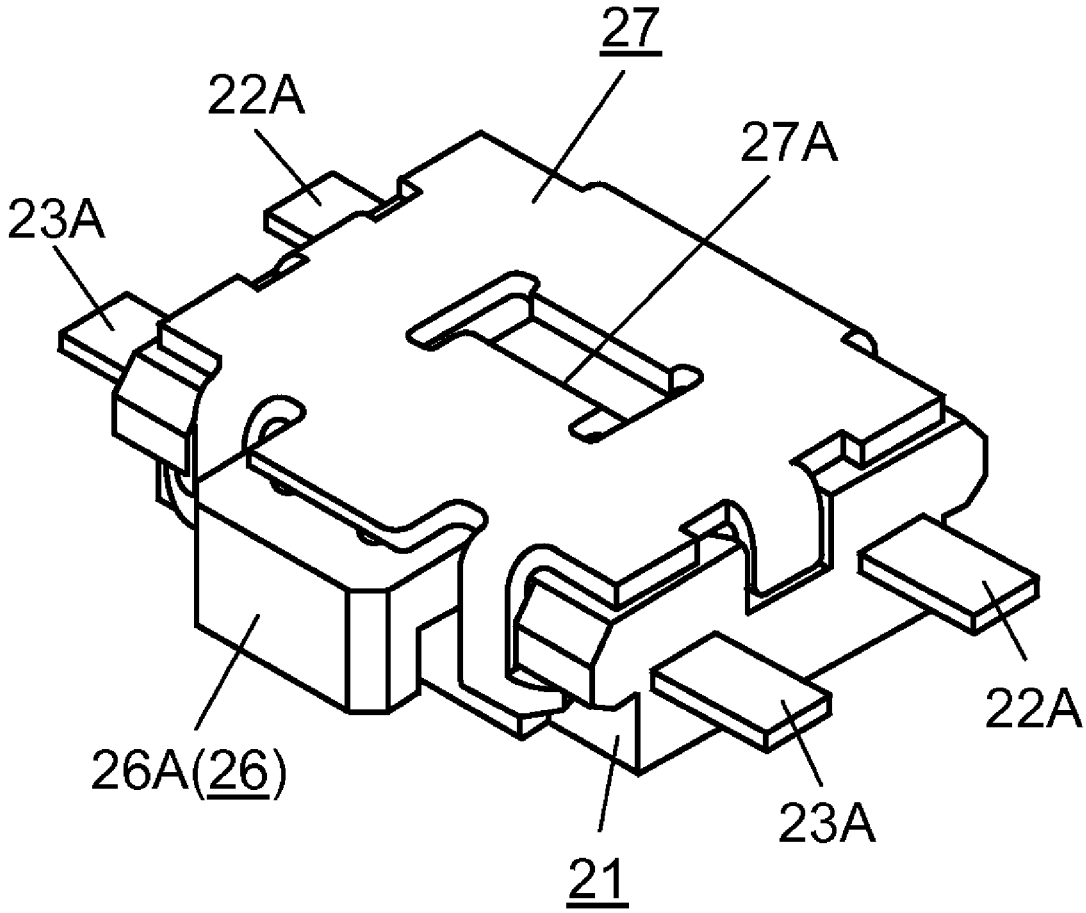
FIG. 1 is an external view of a push switch according to an embodiment of the present invention.
Figure 2:
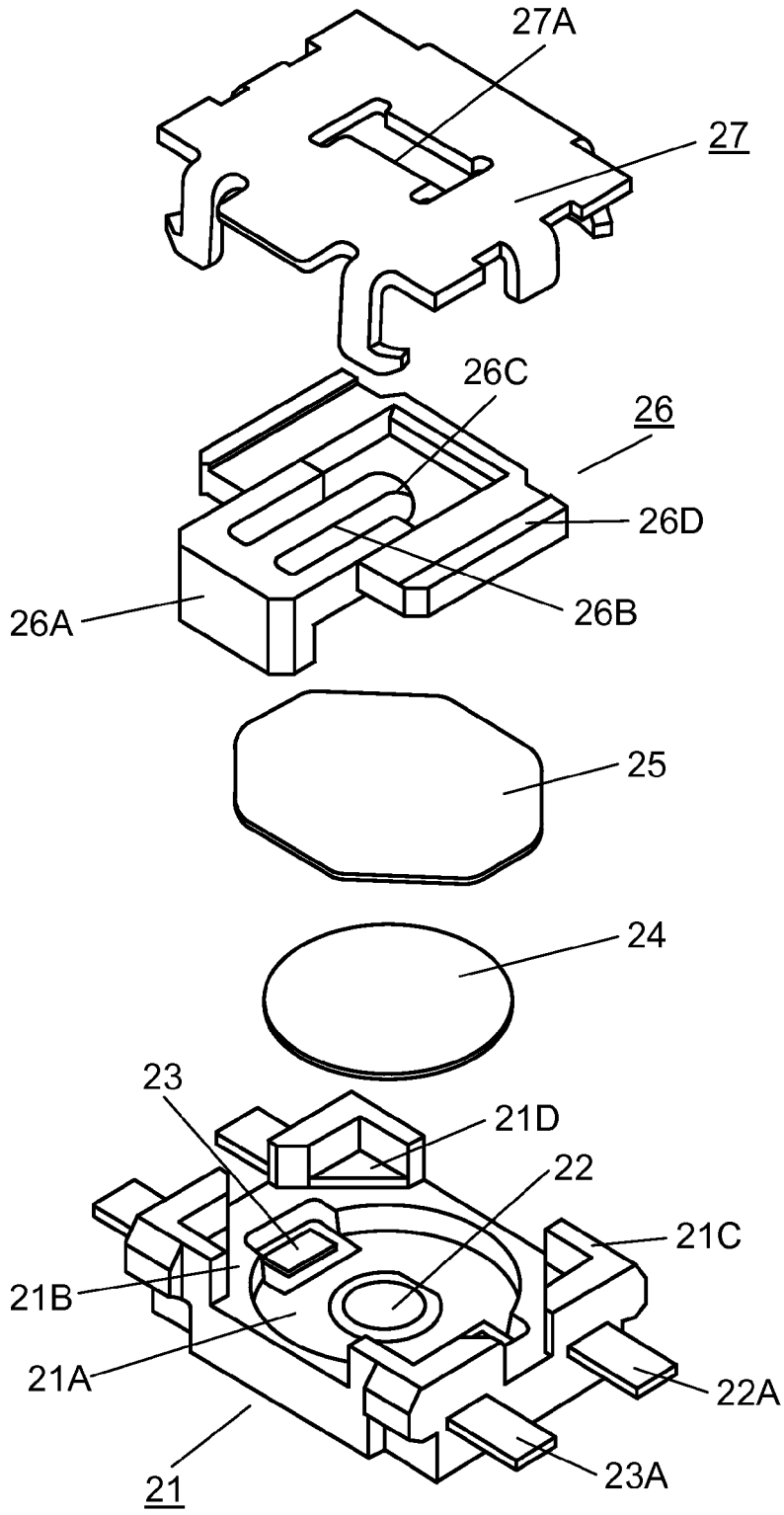
FIG. 2 is an exploded perspective view of the push switch.
Figure 3:
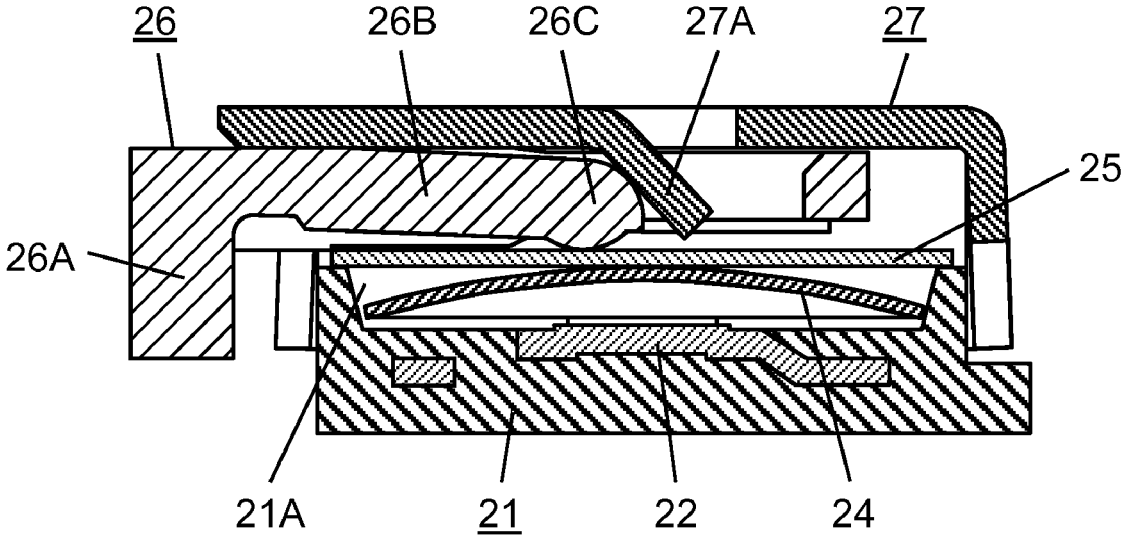
FIG. 3 is a side sectional view of the push switch.
Figure 4:
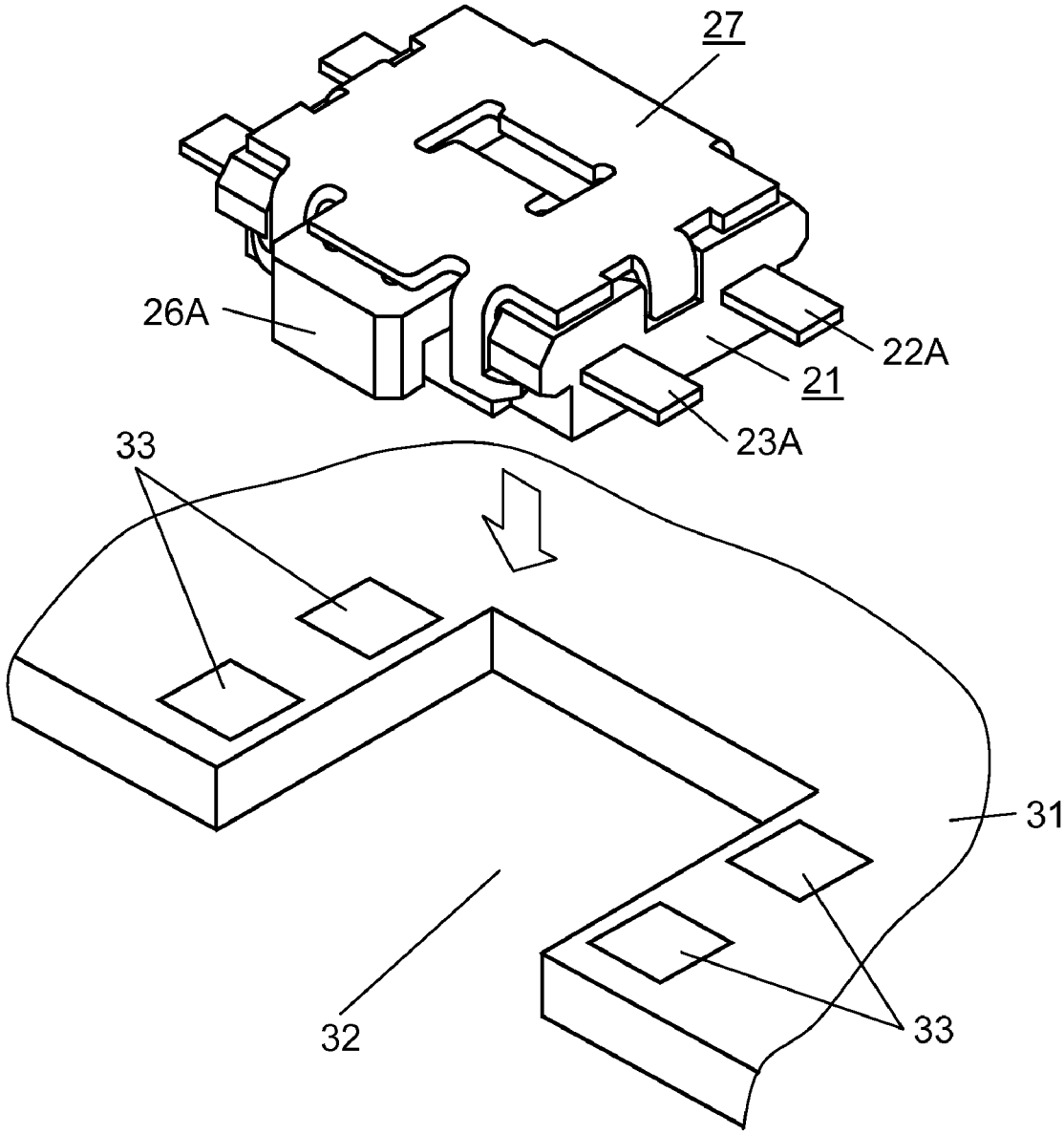
FIG. 4 is an external view explaining a state where a wiring board of an electronic device is loaded with the push switch.
Figure 5:
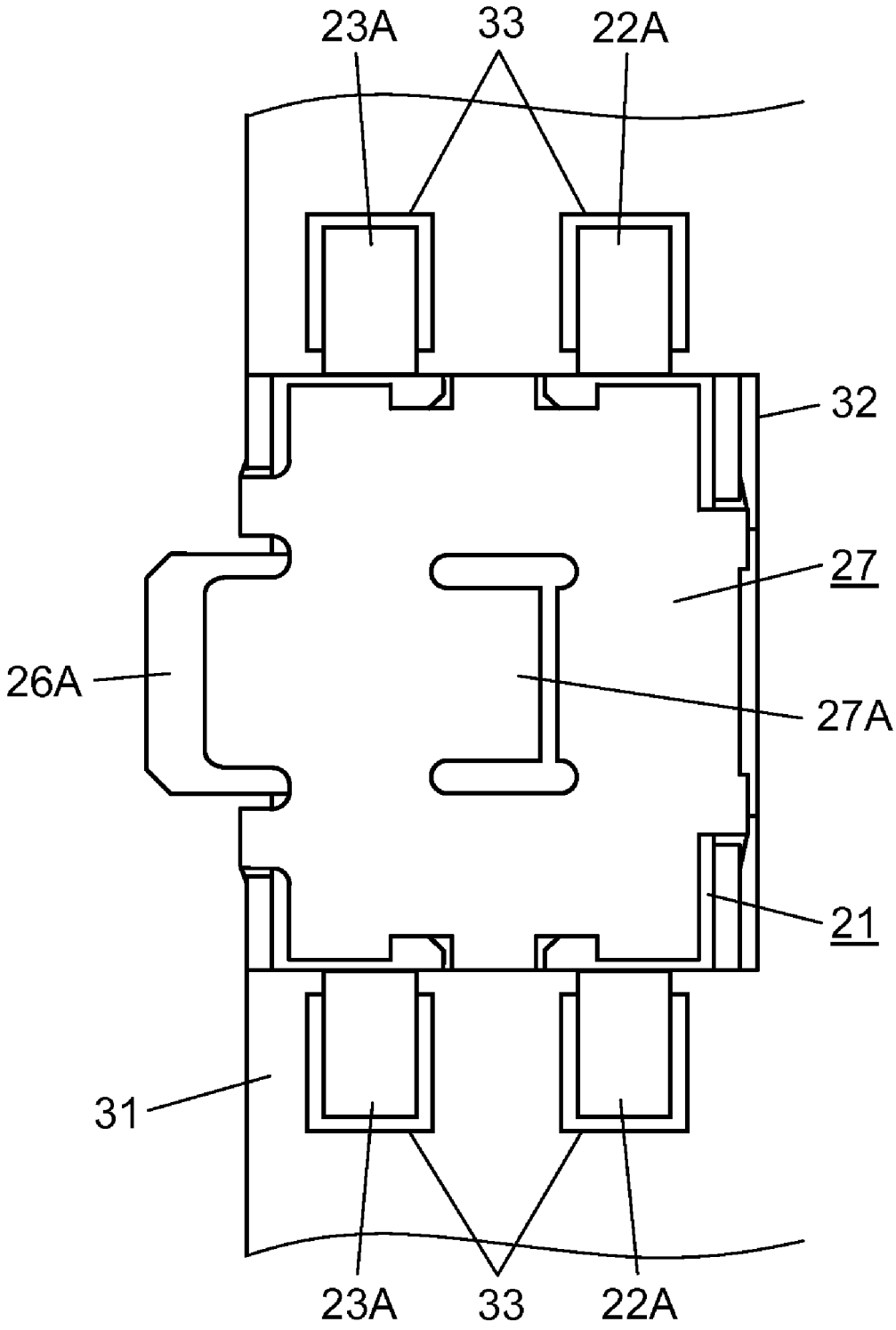
FIG. 5 is a plan view of a state where the push switch is inserted in a cut-out section of the wiring board of an electronic device.
Figure 6:
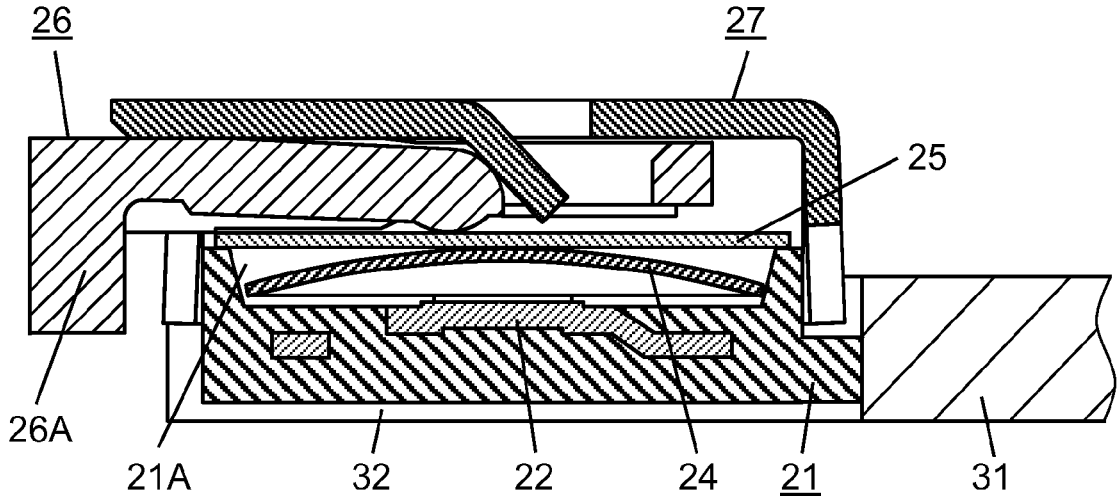
FIG. 6 is a side sectional view of a mounted state.

FIG. 1 is an external view of a push switch according to an embodiment of the present invention. FIG. 2 is an exploded perspective view of the push switch. FIG. 3 is a side sectional view of the push switch. FIG. 4 is an external view explaining a state where a wiring board of an electronic device is loaded with the push switch. FIG. 5 is a plan view of a state where the push switch is inserted in a cut-out section of a wiring board of an electronic device. FIG. 6 is a side sectional view of a mounted state.

A case 21 made of an insulating resin in a substantially rectangular shape seen from above has open-top concave section 21A at a central section of plate section 21B. On the inner bottom surface of concave section 21A, central fixed contact 22 is provided at the center and two outer fixed contacts 23 are provided at symmetrical positions sandwiching central fixed contact 22 by insert molding in an electrically independent manner. Each of terminals 22A connected to central fixed contact 22 and led outward from case 21 and terminals 23A connected to outer fixed contacts 23 and led outward from case 21 is also fixed by insert molding by use of an insulating resin.

Terminals 22A and 23A can be led out at positions set based upon a mean height position as the vicinity of the center in a height direction of each side surface of case 21, which is above the bottom surface thereof. Terminal 22A connected to central fixed contact 22 is led out on the rear side and terminal 23A connected to outer fixed contact 23 is led out on the front side, the terminals taking a horizontal band shape. The inner bottom surface of concave section 21A of case 21 is set so as to be located below the lower surface positions of terminals 22A, 23A.

Each of four corner sections of plate section 21B is provided with corner projecting section 21C having a substantially L shape and projecting upward, and in an inner base portion of each of four corner projecting sections 21C, step section 21D is provided. Each step section 21D is formed with its upper surface being a plane surface and with a dimension of its height identical to each other at a position higher than the surface of plate section 21B by a predetermined dimension.

Movable contact 24 is made of an elastic metal sheet, has an open-bottom circular dome shape, and is housed inside concave section 21A of case 21. The peripheral lower end of the contact is placed on outer fixed contacts 23 and the lower surface of the dome-shaped central section is opposed to central fixed contact 22 with a space formed therebetween. Protective sheet 25 is made of an insulating film, provided with an adhesive, not shown, on its lower surface, and made to adhere to the upper surface of plate section 21B so as to cover concave section 21A of case 21.

Numeral 26 denotes an operating body made of an insulating resin, where operating section 26A located in a projecting manner on the front surface side of case 21 is provided, bar-shaped elastic projection 26B, with its end formed as pushing section 26C in substantially spherical shape, is formed in a projecting manner behind operating section 26A, and frame-shaped sliding section 26D is provided surrounding the periphery of elastic projection 26B while forming a space therewith. Sliding section 26D is placed on step sections 21D in bases of corner projecting sections 21C of case 21, and disposed not in sliding contact with the surface of protective sheet 25 so as to make operating body 26 longitudinally movable.

Cover 27 made of a metal plate is disposed on corner projecting sections 21C of case 21, and controls upward movement of operating body 26. The cover is fixed to case 21 while pushing section 26C at the end of elastic projection 26B is in a contact state with the front surface of inclined surface 27A provided in the central portion.

Regarding the push switch according to the present embodiment configured as described above, its operation is described below.

First, when operating section 26A of operating body 26 projecting from case 21 is horizontally pushed in backward, sliding section 26D moves backward on step sections 21D of case 21. Pushing section 26C at the end of elastic projection 26B, which is in contact with inclined surface 27A of cover 27, moves as guided diagonally downward along inclined surface 27A. Pushing section 26C moving downward pushes down the dome-shaped central section of movable contact 24 through protective sheet 25. When the push-down force exceeds elastic reverse force of movable contact 24, the dome-shaped portion is transformed into a bottom convex shape accompanied by a sense of click, and its lower surface comes into contact with central fixed contact 22, so that the switch is turned on.

When the force having pushed in operating section 26A is released, movable contact 24 is self-restored to the original dome shape rounded upward, accompanied by a sense of click, and the lower surface of the central section is separated from central fixed contact 22, so that the switch is turned off. At that time, in receiving upward energizing force due to the self-restoring force of movable contact 24 through protective sheet 25, pushing section 26C of operating body 26 is pushed back upward. Pushing section 26C moves as guided diagonally upward along inclined surface 27A of cover 27, and with this movement of pushing section 26C, sliding section 26D moves forward on step sections 21D of case 21, and operating body 26 returns to the original state.

As described above, in the present embodiment, sliding section 26D of operating body 26 moves on step sections 21D. Since sliding section 26D does not move on protective sheet 5 made of an insulating film as in the conventional case, operating body 26 longitudinally moves smoothly with small friction resistance, thereby giving a favorable operational feel with a sense of light click at the time of elastic reversal and self-restoration of movable contact 24.

Next described is a state where the push switch according to the present embodiment is loaded on a wiring board of an electronic device.

As shown in FIG. 4, numeral 31 denotes a wiring board of an electronic device for loading of the push switch, and at an edge section of the wiring board, rectangular cut-out section 32 is provided with its front side open. At positions corresponding to terminals 22A, 23A of the push switch, lands 33 for terminals which are connected to a circuit, not shown, are respectively provided in rectangular shape.

Cut-out section 32 is provided for receiving insertion of a portion below the lower surfaces of terminals 22A, 23A led out from each side surface of case 21. Cut-out section 32 is set to have a width slightly larger than a width of case 21 so as to be capable of receiving insertion of case 21 while preventing displacement, and have a depth in dimension approximately the same as a longitudinal dimension of case 21 so as to stabilize the push switch on wiring board 31 while not hindering the operation of pushing in operating section 26A.

The plan view of FIG. 5 shows the state where the push switch is inserted and disposed. As seen from the drawing, positions of respective lands 33 of wiring board 31 are set such that respective spaces from the back-side end surface of cut-out section 32 to the centers of longitudinal widths of respective lands 33 are shorter than respective spaces from the rear end of case 21 as the portion of the push switch which is inserted into cut-out section 32 to the centers of widths of respective terminals 22A, 23A.

In other words, the central positions of respective lands 33 are provided at positions slightly displaced backward from the central positions of terminals 22A, 23A. The displacement may be set dimensionally to the range of 0.02 mm to 0.2 mm.

As thus described, with lands 33 for soldering of the terminals provided in wiring board 31, condensing force generated in solidification of molten solder at the time of soldering acts so as to position respective terminals 22A, 23A at the centers of widths of lands 33, and hence the push switch is energized toward the back side of cut-out section 32. As shown in FIG. 6, the lower rear end of case 21 inserted into cut-out section 32 comes into close contact with the back-side end surface of cut-out section 32, and then soldered and fixed, to stabilize the position on wiring board 31. Further, also when an excessive load is applied to operating section 26A, that load can be directly received on the end surface of wiring board 31, so that a mounted state with improved mechanical strength can be easily obtained.

As thus described, according to the present embodiment, the portion below terminals 22A, 23A led out from the side surface of case 21 can be inserted and mounted into cut-out section 32 provided in wiring board 31 of the electronic device. Therefore, even an excessive load applied to operating section 26A of operating body 26 can be received on the back-side end surface of cut-out section 32 of wiring board 31 through case 21, so as to improve mechanical strength more than in the case of the push switch in single use.

Further, since the inner bottom surface of concave section 21A of case 21 is located below the upper surface of wiring board 31 as the soldering position, the height position of operating body 26 is close to the wiring board surface side, so as to obtain a mounted state having a low positional relation. This can suppress a moment of the pressing operation which is applied to the soldered section of each of terminals 22A, 23A, leading to more improvement in mechanical strength and suppression of the height from wiring board 31 of the push switch.

It is to be noted that the position where each of terminals 22A, 23A is led out from case 21 is not restricted to the height position in the vicinity of the center of the side surface, but at any position so long as having a margin for allowing insertion of the portion below each of terminals 22A, 23A of case 21 into cut-out section 32 of wiring board 31. For example, it is more preferable to lead out terminals 22A, 23A from the upper height position of the side surface of case 21 since a configuration with a smaller dimension of the height from wiring board 31 can be formed.

Moreover, the shape of each of terminals 22A, 23A is not restricted to the plane shape, but each of terminals 22A, 23A may be of a surface-mounted type in so-called J-bent shape, gull-wing shape, or the like.

Next, an example of embodiments with a case in another form is described with reference to FIGS. 7 to 9.

Figure 7:
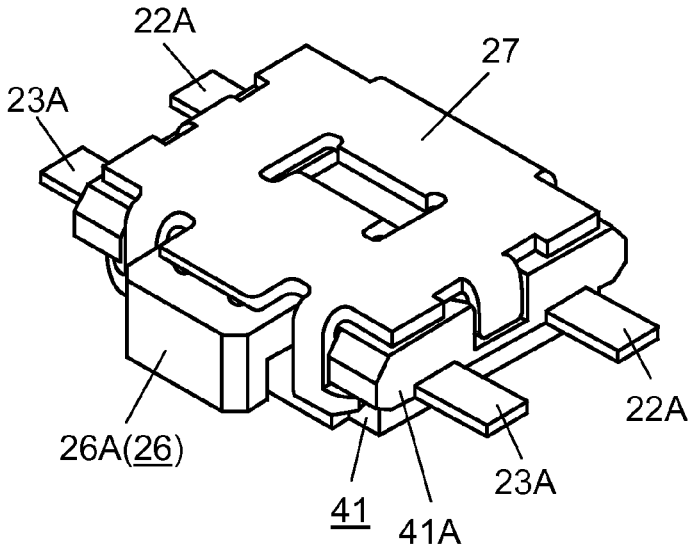
FIG. 7 is an external view of a push switch with a case in another form.

FIG. 7 is an external view of a push switch with a case in another form. FIG. 8 is a bottom view of the push switch with the case in another form. FIG. 9 is an external view of a state where the push switch is inserted in a cut-out section of a wiring board of an electronic device.

In the figure, numeral 41 denotes a case with terminals 22A, 23A insert-molded and fixed by use of an insulating resin. An operation performed on operating section 26A located as projecting forward makes operating body 26 longitudinal movable, and from thereabove, cover 27 is fixed. Each of terminals 22A, 23A is led out in plane shape at a symmetrical position from a mean height position as approximately the center in a height direction of each side surface of case 41.

With the lower surface position of each of terminals 22A, 23A taken as a border, rest section 41A is configured where an upper portion of each of right and left side sections of case 41 projects outward more than a lower portion thereof.

Since other configurations are the same as described above and operations thereof are also the same, descriptions of those configurations are not given.

Figure 9:
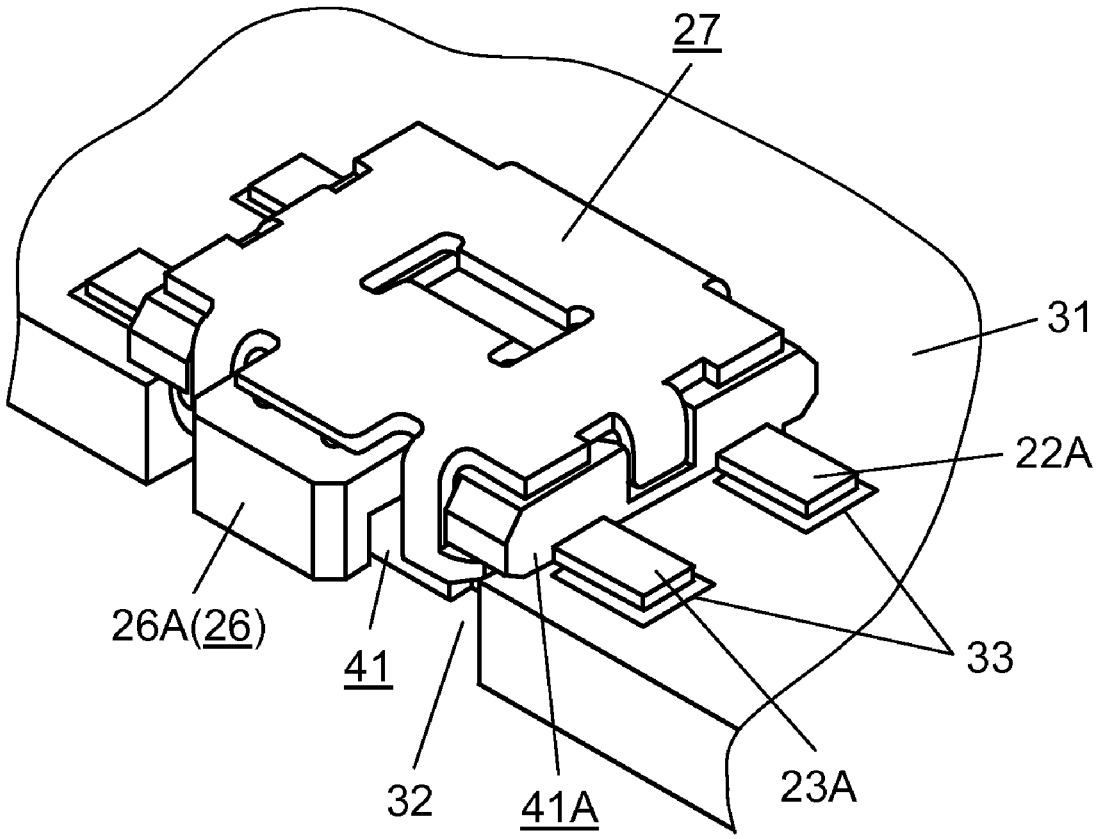
FIG. 9 is an external view of a state where the push switch is inserted in the cut-out section of a wiring board of an electronic device.

As shown in FIG. 9, when the portion below each of terminals 22A, 23A of case 41 is brought into the state of being inserted in cut-out section 32 of wiring board 31, each of terminals 22A, 23A comes into the state of being located on land 33, and also rest section 41A of case 41 comes into the state of being placed on wiring board 31.

As thus described, in the state of the push switch being inserted in cut-out section 32 of wiring board 31, the push switch according to the present embodiment can be placed in a larger area and more stably on both sides of case 41 due to rest sections 41A than a push switch placed on wiring board 31 only with terminals 22A, 23A, thereby allowing improvement in mounting operationality.

Further, since an exposed area of the lower surface of each of terminals 22A, 23A increases, the soldering area increases. It is thereby possible to strengthen mechanical strength after solder-mounting.

It should be noted that, from the viewpoint of densifying a component loaded on wiring board 31, rest section 41A is preferably provided only in each side surface direction of case 41 so as to make the occupied area small. On the other hand, from the viewpoint of improving the mounting operationality, it may be configured such that rest section 41A is projected also in the rear surface portion of case 41.

An example of embodiments with a terminal in another form is described with reference to FIG. 10.

Figure 10:
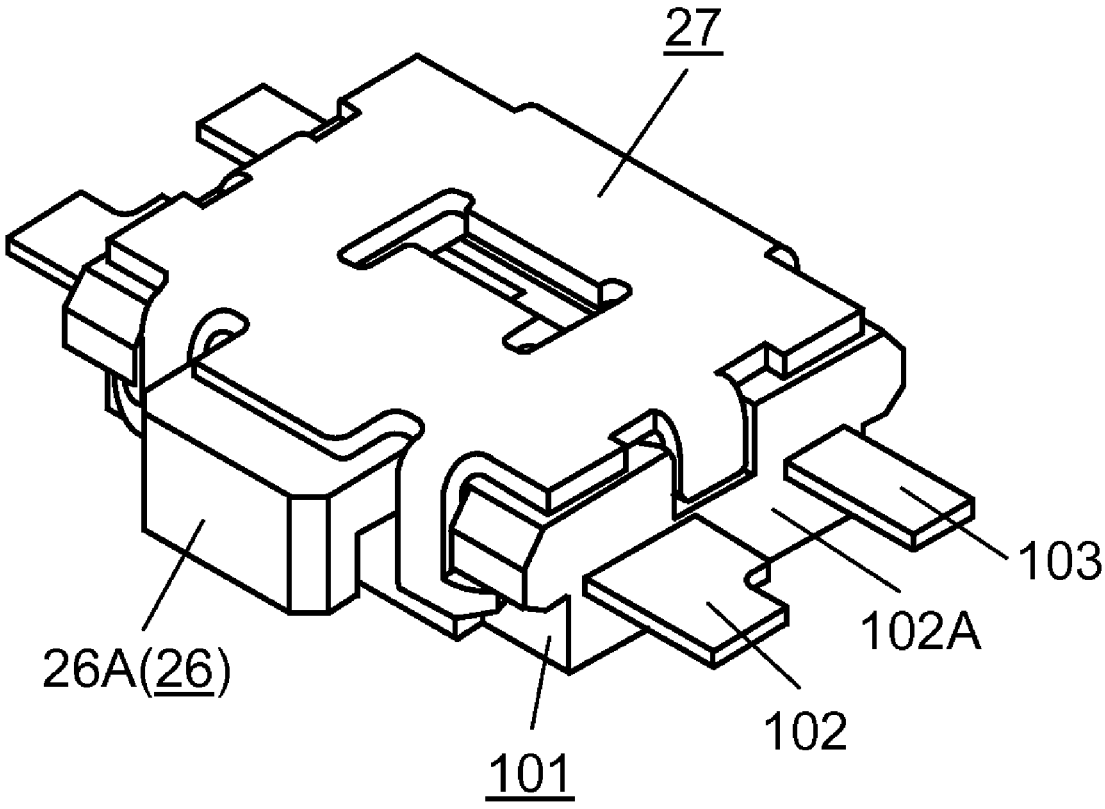
FIG. 10 is an external view of a push switch with a terminal in another form.

FIG. 10 is an external view of a push switch with a terminal in another form.

In the figure, numeral 101 denotes a case with front terminal 102 and rear terminal 103 insert-molded and fixed by use of an insulating resin. An operation performed on operating section 26A located as projecting forward makes operating body 26 longitudinal movable, and from thereabove, cover 27 is fixed. Each of front terminal 102 and rear terminal 103 is led out in plane shape at a symmetrical position from a mean height position as approximately the center in a height direction of each side surface of case 101.

A width of rear terminal 103 is the same as the widths of those terminals described in FIGS. 1 to 9, whereas a width of front terminal 102 is set larger than the width of rear terminal 103. Further, front terminal 102 is provided with cut-out section 102A in its end portion.

Since other configurations are the same as those described in FIGS. 1 to 6 and operations thereof are also the same, descriptions of those configurations are not given.

Although the moment of the pushing operation is applied more intensely on front terminal 102 side than on rear terminal 103 side, making the width of front terminal 102 larger can expand a soldering area of front terminal 102, to improve soldering strength. It is thereby possible to increase mechanical strength after solder-mounting against a pushing operation as well as accidentally applied excessive pushing force.

Further, since cut-out section 102A provided at the end of front terminal 102 acts as a solder pool at the time of soldering, it is possible to increase the mechanical strength after solder-mounting. While cut-out section 102A may be provided in either or both of front terminal 102 and rear terminal 103, it is preferably provided at the rear edge section of front terminal 102 shown in FIG. 10. Further, it may be provided as a through hole inside a terminal width of front terminal 102 or rear terminal 103.

An example of embodiments with a terminal in another form is described with reference to FIG. 11.

Figure 11:
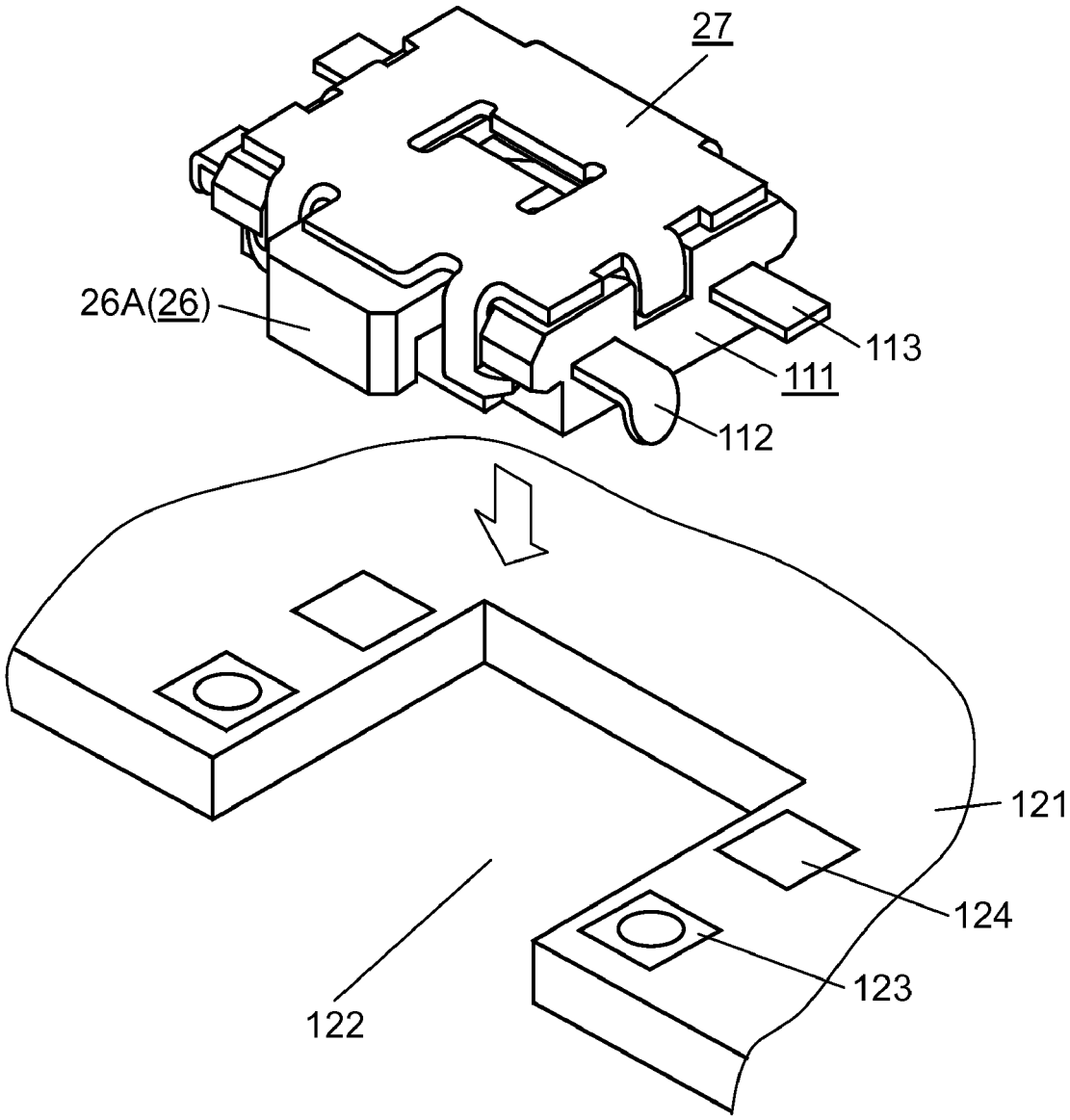
FIG. 11 is an external view explaining a state where a push switch with a terminal in another form is loaded on a wiring board of an electronic device.
Figure 12:
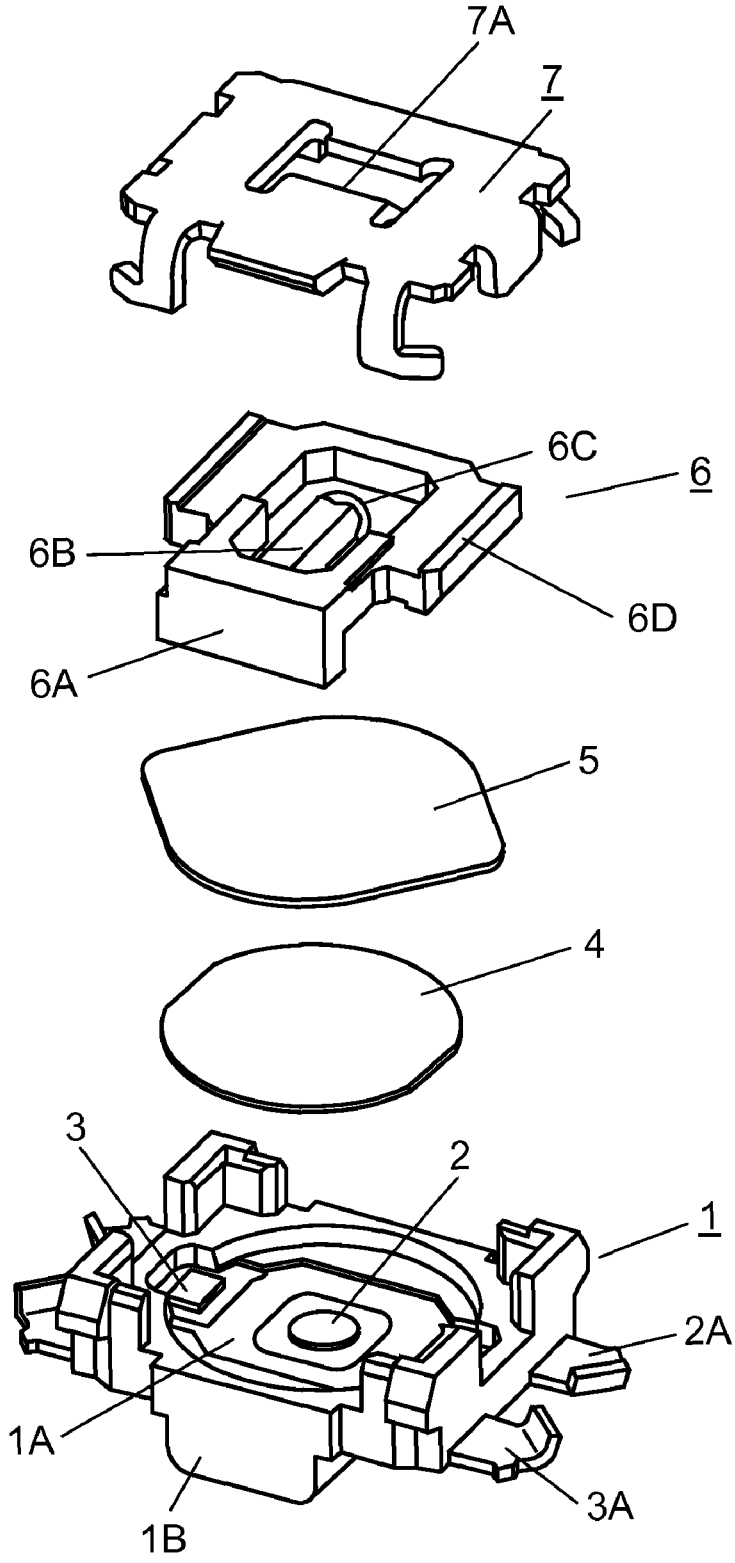
FIG. 12 PRIOR ART
FIG. 12 is an exploded perspective view of a conventional push switch.
Figure 13:
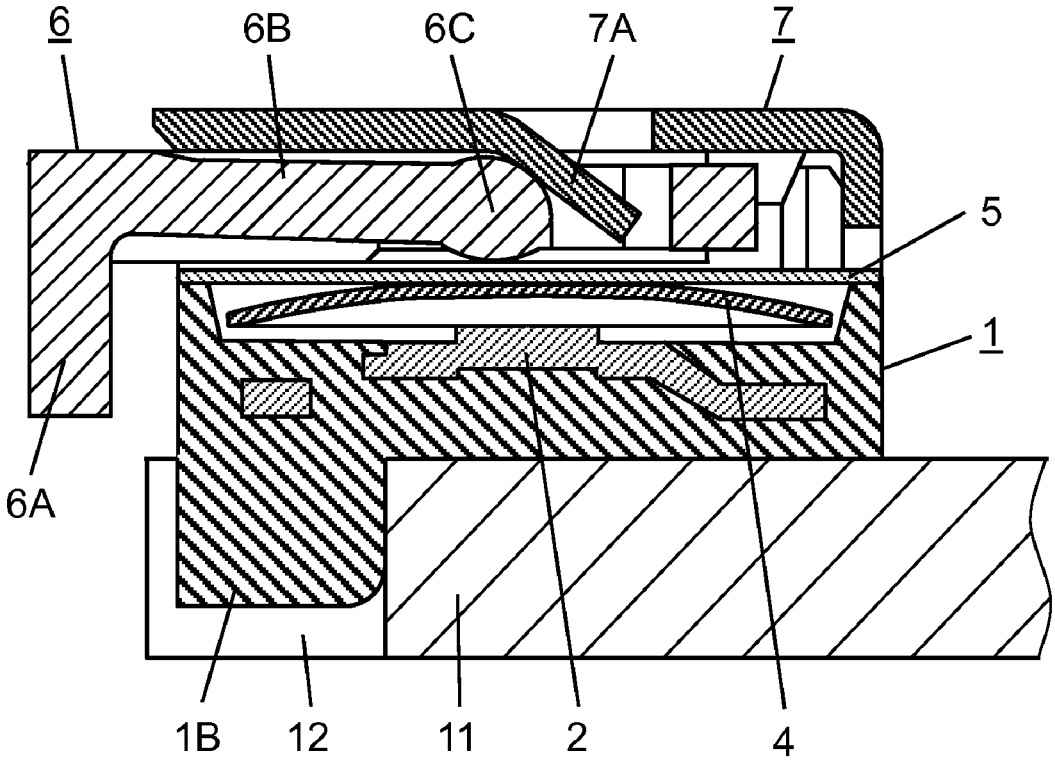
FIG. 13 PRIOR ART
FIG. 13 is a side sectional view of a mounted state of the conventional push switch.

FIG. 11 is an external view explaining a state where a push switch with a terminal in another form is loaded on a wiring board of an electronic device.

In the figure, numeral 111 denotes a case with front terminal 112 and rear terminal 113 insert-molded and fixed by use of an insulating resin. An operation performed on operating section 26A located as projecting forward makes operating body 26 longitudinal movable, and from thereabove, cover 27 is fixed. Each of front terminal 112 and rear terminal 113 is respectively led out in plane shape at a symmetrical position from a mean height position as approximately the center in a height direction of each side surface of case 111.

Front terminal 112 is led out in plane shape from the side surface of case 111, and its end side is bent downward.

Since other configurations are the same as those described in FIGS. 1 to 6, and operations thereof are also the same, descriptions of those configurations are not given.

As shown in FIG. 11, numeral 121 is a wiring board of an electronic device for loading of the push switch, and at an edge section of the wiring board, rectangular cut-out section 122 is provided with its front side open. At a position corresponding to front terminal 112 of the push switch, land 123 provided with a through hole for a terminal which is connected to a circuit, not shown, is provided in rectangular shape. Further, at a position corresponding to rear terminal 113, land 124 for a terminal which is also connected to the circuit, not shown, is provided in rectangular shape.

The push switch mounted on wiring board 121 is soldered with the end side of front terminal 112 in the state of being inserted inside the through hole of land 123, and is hence firmly fixed. It is thereby possible to further increase mechanical strength after solder mounting against a moment of the pushing operation intensely applied to front terminal 112.

Figure 8:
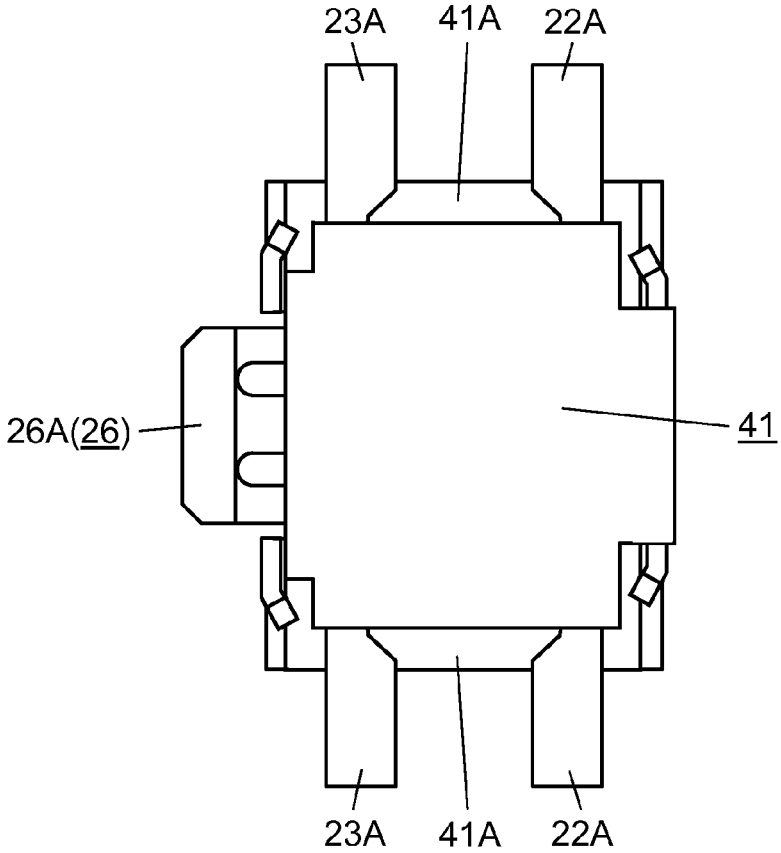
FIG. 8 is a bottom view of the push switch with the case in another form.

In addition, although not shown, the push switches shown in FIGS. 10 and 11 may also be provided with rest section 41A as shown in FIGS. 7 to 9 in such a manner that, with a lower surface position of each of terminals 102, 103, 112, 113 led out from each of cases 101, 111 taken as a border, an upper portion of each of at least right and left side sections of each of cases 101, 111 is projected outward more than a lower portion thereof.

It is to be noted that, although the shape of the case is rectangular in the embodiments, the present invention is not restricted to the shape of the case. The present invention is applicable to arbitrary shapes such as a polygonal shape and an elliptic shape.

The push switch of the present invention has a characteristic of suppressing a height from a wiring board when being in a mounted state without causing deterioration in mechanical strength, and is broadly applicable to a variety of electronic devices having input operating sections.

What is claimed is:

1. A push switch, comprising:

an open-bottom dome-shaped movable contact made of an elastic metal sheet;

a case which has on a plane surface an open-top concave section for housing the movable contact, and includes a plurality of electrically independent fixed contacts on an inner bottom surface of the concave section, and a terminal connected to one of the fixed contacts and extending outwardly from the case;

a protective sheet made of an insulating film disposed on the plane surface of the case;

an operating body which includes an operating section projecting from the case, the operating body being longitudinally movable relative to the case; and a cover which is fixed to the case from above the operating body, wherein the terminal extends outwardly from a side section of the case, and a lower surface position of the terminal where soldering is performed is located above a bottom surface of the case.

2. The push switch according to claim 1, wherein the inner bottom surface of the concave section of the case is located below the lower surface position of the terminal where soldering is performed.

3. The push switch according to claim 1, wherein the case located below the lower surface position where soldering is performed is inserted and mounted into a cut-out section provided at an edge section of a wiring board.

4. The push switch according to claim 1, wherein the case has a substantially rectangular shape.

5. The push switch according to claim 1, further comprising rest sections which project outward from upper portions of a left side section and a right side section of the case, respectively, wherein the lower surface position of the terminal is disposed at an edge of one of the rest sections.

6. The push switch according to claim 1, further comprising corner projecting sections projecting from corner sections of the plane surface of the case, respectively, each corner projecting section having an L-shaped cross section, and step sections projecting from the plane surface above an upper surface of the protective sheet, the step sections being formed in a base of the corner projecting sections, respectively, and wherein the operating body is placed on an upper surface of the step sections.

7. The push switch according to claim 1, wherein the terminal is one of a plurality of terminals which are provided at symmetrical positions of the case, the terminals including a front terminal at a front side of the case and a rear terminal at a rear side of the case, and wherein a width of the front terminal is greater than a width of the rear terminal.

8. The push switch according to claim 1, wherein the terminal is provided with a cut-out section, and the terminal is one of a plurality of terminals which are provided at symmetrical positions of the case.

9. The push switch according to claim 1, wherein the terminal is one of a plurality of terminals which are provided at symmetrical positions of the case, and the terminals include a front terminal located at a front side of the case and having an end bent downward.

10. An electronic device, loaded with a push switch according to claim 1, wherein said device has a wiring board having a land for the terminal and a cut-out section into which the push switch is inserted, wherein a rear end section of the push switch is in contact with a back-side end surface of the cut-out section, and wherein a distance from the back-side end surface of the cut-out section to a center of a longitudinal width of the land is shorter than a space from the rear end section of the push switch to a center of a width of the terminal.

11. The electronic device according to claim 10, wherein the land is one of a plurality of lands and the terminal is one of a plurality of terminals, and wherein the lands and terminals are disposed symmetrically at symmetrical positions of the case.

12. The push switch according to claim 1, wherein the protective sheet is adhered to the plane surface of the case with an adhesive.

13. An electronic device comprising:

a wiring board having a top surface, a side edge, and a cut-out section formed in the side edge; and a push switch disposed in the cut-out section, the push switch including:

(i) an open-bottom dome-shaped movable contact made of an elastic metal sheet;

(ii) a case which has on a plane surface an open-top concave section housing the movable contact, and includes a plurality of electrically independent fixed contacts on an inner bottom surface of the concave section, and a terminal to connected one of the fixed contacts and extending outwardly from the case;

(iii) a protective sheet made of an insulating film disposed on the plane surface of the case;

(iv) an operating body which includes an operating section projecting from the case, the operating body being longitudinally movable relative to the case; and (v) a cover which is fixed to the case from above the operating body, wherein the terminal extends outwardly from a side section of the case, and a lower surface of the terminal is located above a bottom surface of the case, wherein the lower surface of the terminal is connected to the top surface of the wiring board, and the inner bottom surface of the concave section of the case is located below the lower surface of the terminal and below the top surface of the wiring board.

14. The electronic device of claim 13, wherein at least one of the fixed contacts is located below the top surface of the wiring board.

15. The electronic device of claim 13, further comprising rest sections which project outward from upper portions of a left side section and a right side section of the case, respectively, wherein the terminal projects from one of the rest sections, and wherein a bottom surface of each of the rest sections rests on the top surface of the wiring board, and a portion of the case below the rest sections is disposed in the cut-out section.

16. The electronic device of claim 13, further comprising corner projecting sections projecting from corner sections of the plane surface of the case, respectively, each corner projecting section having an L-shaped cross section, and step sections projecting from the plane surface above an upper surface of the protective sheet, the step sections being formed in a base of the corner projecting sections, respectively, and wherein the operating body is placed on an upper surface of the step sections.

* * * * *